US007147082B2

(12) United States Patent
Lilie et al.

(10) Patent No.: US 7,147,082 B2
(45) Date of Patent: Dec. 12, 2006

(54) SUCTION MUFFLER FOR A RECIPROCATING HERMETIC COMPRESSOR

(75) Inventors: Dietmar Erich Berhard Lilie, Joinville (BR); Fabricio Caldeira Possamai, Joinville (BR); Marcio Luiz Todescat, Joinville (BR); Filho José Feuser, Joinville (BR)

(73) Assignee: Empresa Brasileria de Compressores S.A. Embraco, Joinville (BR)

( * ) Notice: Subject to any disclaimer, the term of this patent is extended or adjusted under 35 U.S.C. 154(b) by 313 days.

(21) Appl. No.: 10/480,210

(22) PCT Filed: Jun. 8, 2001

(86) PCT No.: PCT/BR01/00072

§ 371 (c)(1),
(2), (4) Date: Dec. 10, 2003

(87) PCT Pub. No.: WO02/101239

PCT Pub. Date: Dec. 19, 2002

(65) Prior Publication Data

US 2004/0170506 A1 Sep. 2, 2004

(51) Int. Cl.

| | |
|---|---|
| ***F01N 1/02*** | (2006.01) |
| ***F01N 1/08*** | (2006.01) |
| *F02M 35/12* | (2006.01) |
| *F04B 49/00* | (2006.01) |
| *F04B 53/00* | (2006.01) |

(52) U.S. Cl. ..... 181/262; 181/268; 181/272; 181/275; 181/229; 417/312; 417/902

(58) Field of Classification Search ..... 181/262, 181/268, 272, 275, 229; 417/312, 902
See application file for complete search history.

(56) References Cited

U.S. PATENT DOCUMENTS 2,297,530 A * 9/1942 Blanchard ..... 181/229
2,955,671 A * 10/1960 Leistritz ..... 181/229
4,333,544 A * 6/1982 Seeger ..... 181/266
4,755,108 A * 7/1988 Todescat et al. ..... 417/312
5,201,640 A * 4/1993 Heinzelmann et al. ..... 417/312
5,584,674 A * 12/1996 Mo ..... 417/312
5,647,314 A * 7/1997 Matsumura et al. ... 123/184.57
5,733,106 A 3/1998 Lee
5,938,411 A * 8/1999 Seo ..... 417/312
5,950,307 A * 9/1999 Lee ..... 29/888.02
6,017,197 A * 1/2000 Jensen et al. ..... 417/312
6,129,522 A * 10/2000 Seo ..... 417/312
6,149,402 A * 11/2000 Kim ..... 417/312

(Continued)

FOREIGN PATENT DOCUMENTS

DE 199 237 34 A1 11/2000

(Continued)

*Primary Examiner*—Edgardo San Martin
(74) *Attorney, Agent, or Firm*—Darby & Darby

(57) ABSTRACT

A suction muffler for a reciprocating hermetic compressor, comprising a hollow body (10) provided with a gas inlet and a gas outlet (12, 14), which are respectively in fluid communication with the gas supply to the compressor and with a suction side thereof, said hollow body (10) defining a plurality of chambers comprising an innermost first acoustic chamber (50) in fluid communication with the gas outlet (14) of the hollow body (10), and a second acoustic chamber (51) surrounding at least partially the first acoustic chamber (50) and in fluid communication with at least one of the parts defined by said first acoustic chamber (50) and by the gas inlet (12) of the hollow body (10).

16 Claims, 4 Drawing Sheets

U.S. PATENT DOCUMENTS

| | | | | |
|---|---|---|---|---|
| 6,206,135 | B1 | 3/2001 | Kim et al. | |
| 6,506,028 | B1 * | 1/2003 | Silveira et al. | 417/312 |
| 6,520,289 | B1 * | 2/2003 | Bo | 181/229 |
| 6,547,535 | B1 * | 4/2003 | Kueon | 417/312 |
| 6,692,238 | B1 * | 2/2004 | Myung et al. | 417/312 |

FOREIGN PATENT DOCUMENTS

| | | | |
|---|---|---|---|
| JP | 03290072 | A * | 12/1991 |
| WO | WO-00/52333 | A1 | 9/2000 |

* cited by examiner

SUCTION MUFFLER FOR A RECIPROCATING HERMETIC COMPRESSOR

This is a U.S. national phase application under 35 U.S.C. §371 of International Patent Application No. PCT/BR2001/000072 filed Jun. 8, 2001. The International Application was published in English on Dec. 19, 2002 as International Publication No. WO/2002/101239 under PCT Article 21(2) which is incorporated by reference herein in its entirety.

FIELD OF THE INVENTION

The present invention refers to a suction muffler for a reciprocating hermetic compressor, particularly of the type used in small refrigeration systems in the region where the refrigerant gas is supplied to the hermetic compressor.

BACKGROUND OF THE INVENTION

As a rule, the reciprocating hermetic compressors present, at the suction side thereof, an acoustic dampening system (acoustic filters or suction mufflers), which is provided inside the shell and which conducts the gas coming from the suction line to the suction valve.

This component has several important functions to the adequate operation of the compressor, such as gas directing, acoustic dampening and, in some cases, thermal insulation of the gas being drawn into the cylinder.

The adequate thermal insulation of the gas being drawn is important to improve the volumetric and energetic efficiencies of the compressor.

During the time elapsed between the admission to the compressor and the admission to the cylinder thereof, the gas temperature is increased, due to heat transferred thereto from the several hot sources existing inside the compressor. The temperature increase of the gas causes an increase in its specific volume and consequently reduces the mass flow of the refrigerant pumped by the compressor. Since the refrigeration capacity of the compressor is directly proportional to the mass flow, reducing said flow results in efficiency loss.

In order to achieve adequate thermal insulation, the current mufflers are usually produced in a material of low thermal conductivity, such as for example, resins, plastic, having good thermal insulation property.

There are known in the art the suction mufflers constructed of injected plastic material and comprising a hollow body, which is provided with gas inlet and gas outlet nozzles and, internally, with a plurality of chambers disposed in a consecutive arrangement and in a linear sequence, and which are maintained in fluid communication in relation to each other and to the gas inlet of the compressor through a duct having an end connected and opened to the gas inlet nozzle of the hollow body; median windows, which are longitudinally spaced from each other and opened to respective chambers; and an opposite end opened to a last chamber of the linear sequence and which is maintained opened to the gas outlet of the hollow body.

DISCLOSURE OF THE INVENTION

It is an object of the present invention to provide a suction muffler for a reciprocating hermetic compressor, which does not present the inconveniences of the known prior art solutions and which produces improved noise attenuation with reduced heating of the gas admitted to the compression cylinder.

This and other objects are achieved by a suction muffler for a reciprocating hermetic compressor, comprising a hollow body provided with a gas inlet and a gas outlet, which are respectively in fluid communication with the gas supply to the compressor and with a suction side of the latter, the hollow body of said muffler defining a plurality of chambers comprising a first innermost acoustic chamber in fluid communication with the gas inlet and the gas outlet of the hollow body, and a second acoustic chamber, surrounding at least partially the first acoustic chamber and in fluid communication with at least one of the parts defined by said first acoustic chamber and by the gas inlet of the hollow body.

BRIEF DESCRIPTION OF THE DRAWINGS

The invention will be described below, with reference to the attached drawings, in which.

DESCRIPTION OF THE ILLUSTRATED EMBODIMENT

Figure 1:
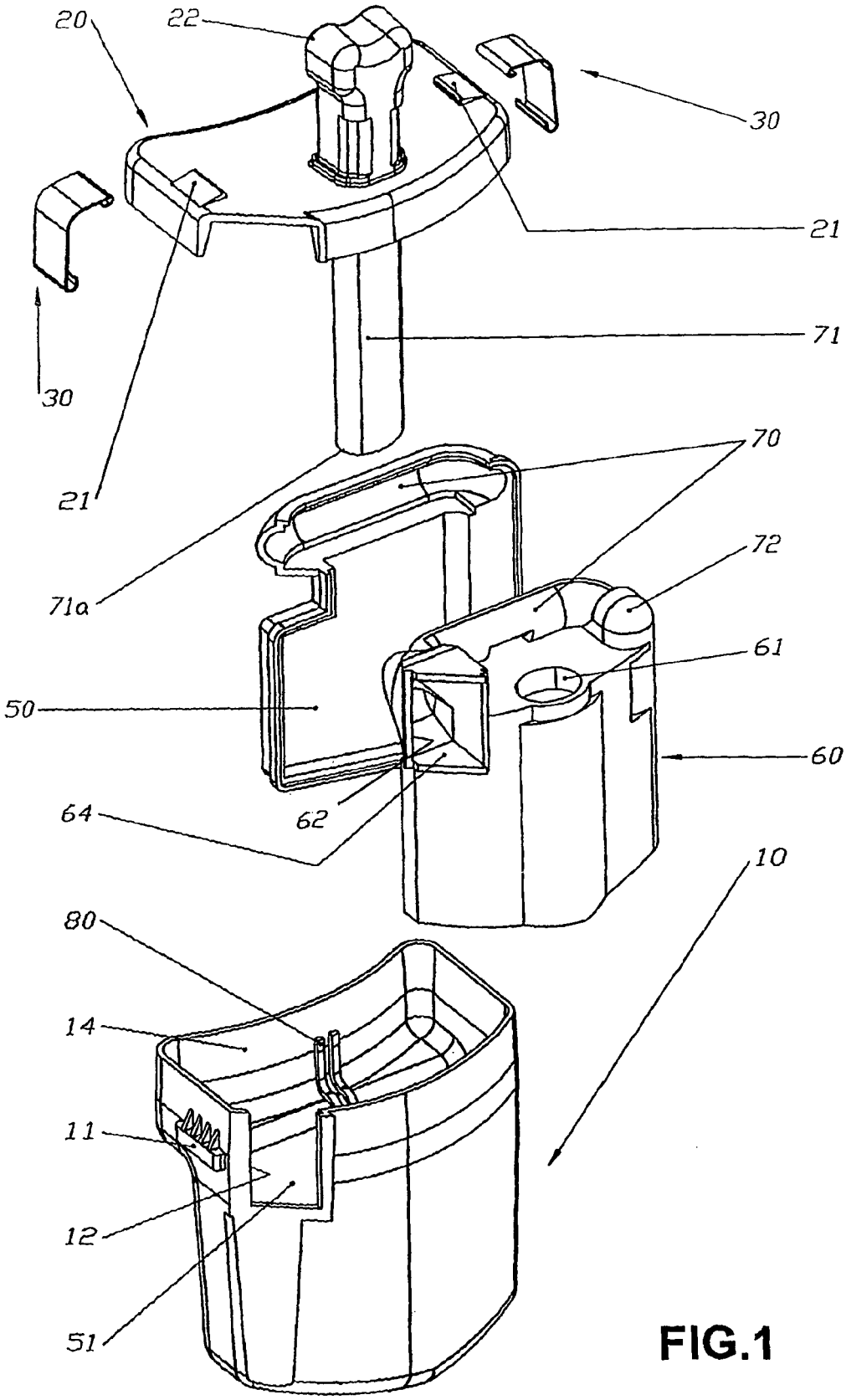
FIG. 1 is an exploded perspective view of a construction for the suction muffler of the present invention.
Figure 2:
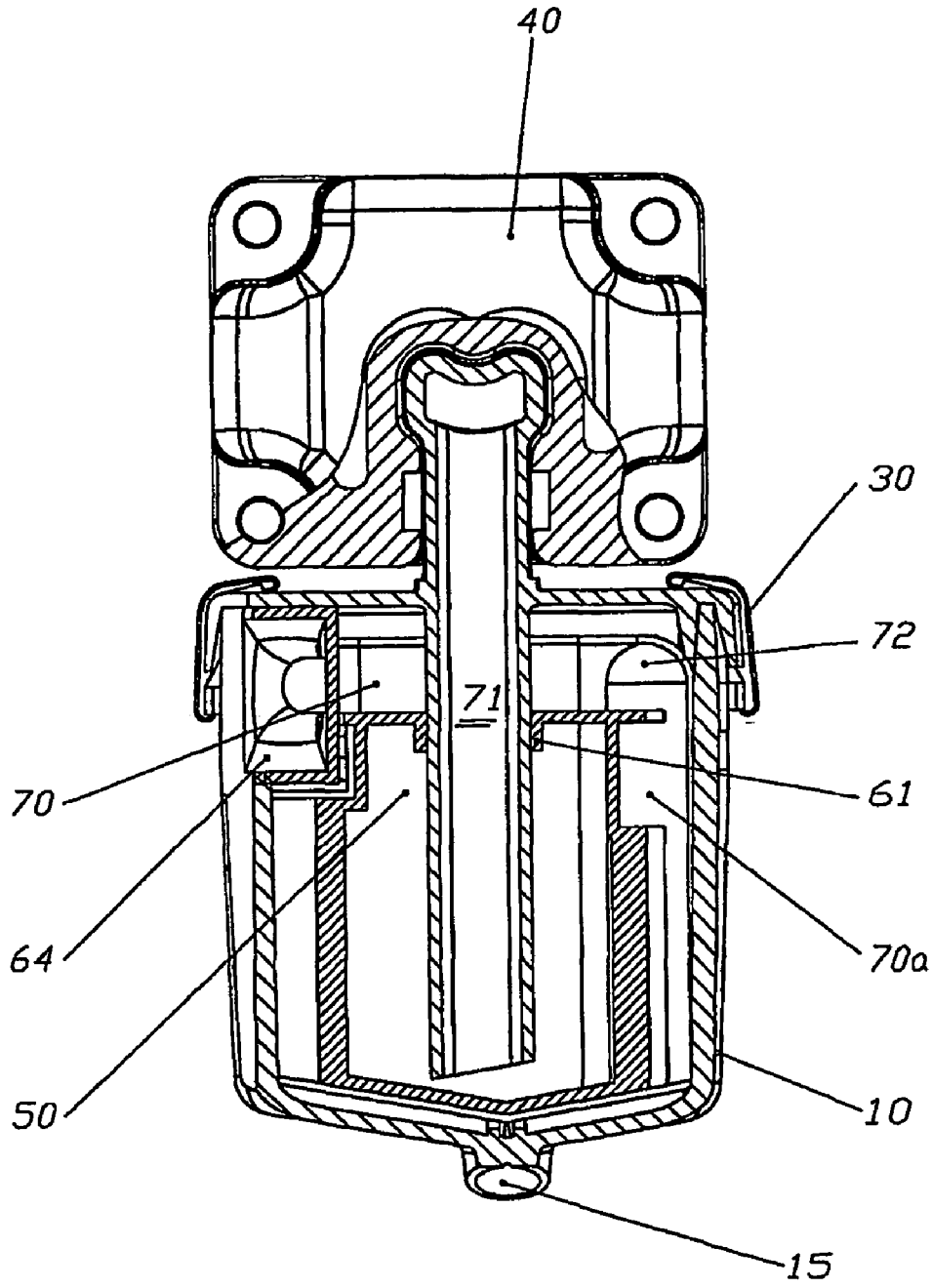
FIG. 2 is a vertical cross-sectional view of the suction muffler of FIG. 1 in the assembled condition.
Figure 3:
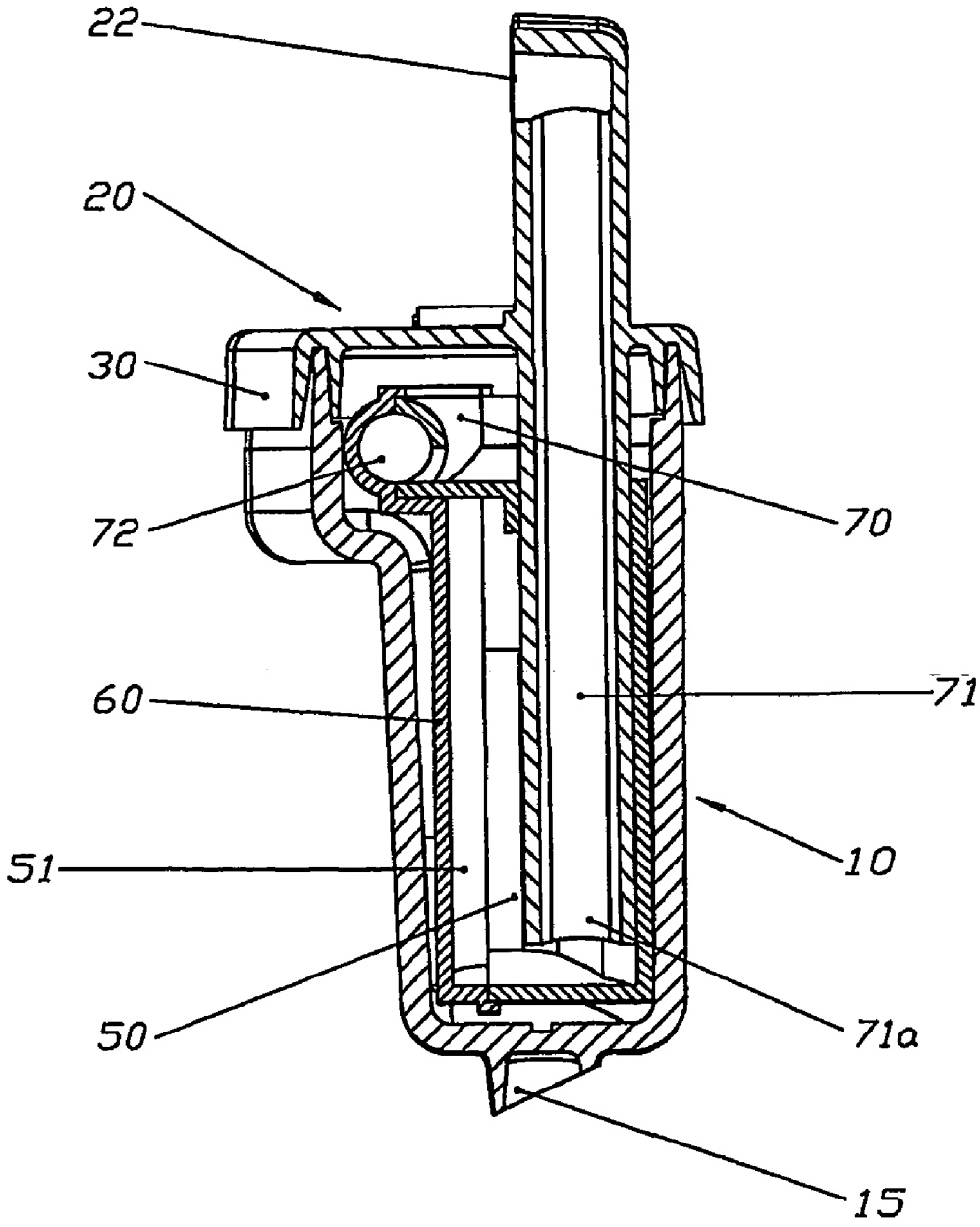
FIG. 3 is a lateral longitudinal sectional view of the suction muffler of FIG. 2 in the assembled condition.
Figure 4:
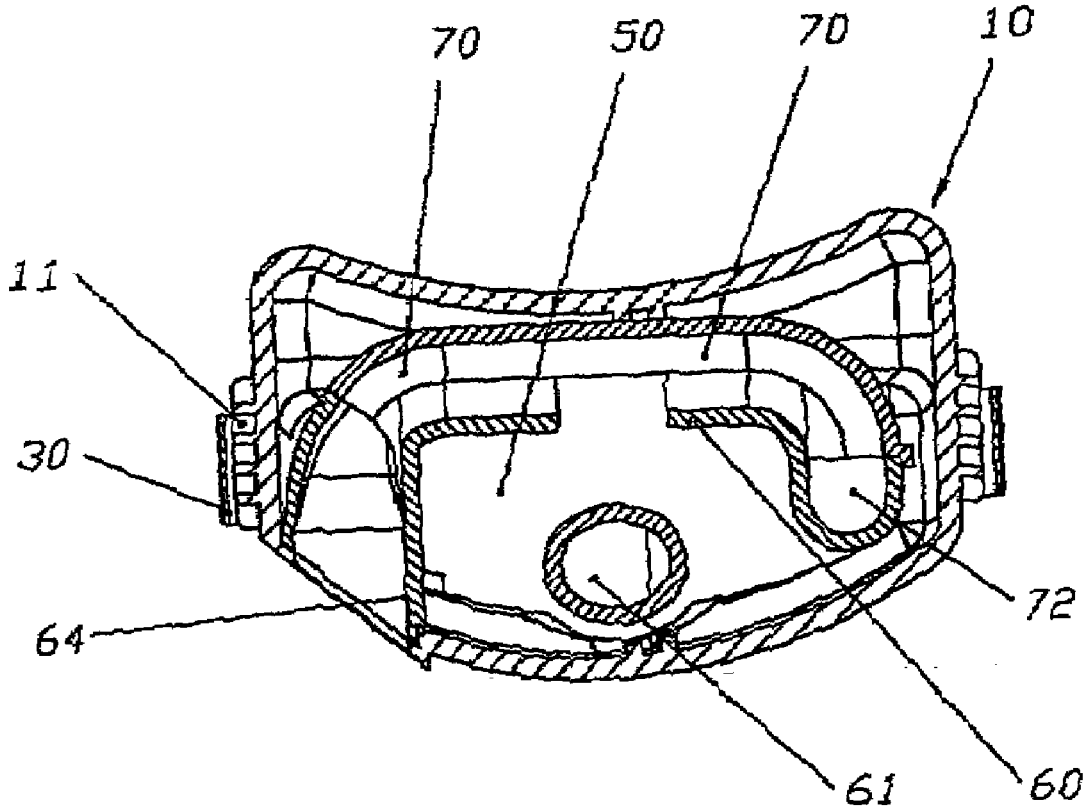
FIG. 4 is a horizontal cross-sectional view of the suction muffler of the present invention.

As illustrated in the appended drawings, the suction muffler of the present invention comprises a hollow body 10 usually obtained in a material of low thermal conductivity, for example with a rectangular cross-section, and which is closed by an upper cover 20 to be seated on the upper edge of the hollow body 10 and there affixed by any adequate means, such as for example a pair of clamps 30 fitted by elastic deformation into respective lugs 11 and 21 provided in both the hollow body 10 and the cover 20.

The hollow body 10 is provided with a gas inlet 12, in fluid communication with the gas supply to the compressor and aligned with the suction tube of the compressor (not illustrated), and a gas outlet 14 in fluid communication with the suction side of the compressor.

The cover 20 incorporates, superiorly and externally, a gas outlet nozzle 22, in the form of a tubular extension, with its free end shaped to be adapted to the suction orifice of a valve plate 40 of the head of the hermetic compressor.

According to the present invention, the hollow body 10 defines a plurality of chambers, disposed in surrounding superposed layers, for example in an eccentric arrangement, comprising a first innermost acoustic chamber 50 in fluid communication with the gas inlet 12 and the gas outlet 14 of the hollow body 10, and a second acoustic chamber surrounding at least partially the first acoustic chamber 50 and in fluid communication with at least one of the parts defined by said first acoustic chamber 50 and by the gas inlet 12 of the hollow body 10.

In the illustrated constructive form, the hollow body 10 defines only two acoustic chambers, the second acoustic chamber 51 being maintained in direct fluid communication with the gas inlet 12 and in restrict and pressure equalizing fluid communication with the inside of the compressor shell.

As illustrated, the hollow body 10 is provided, in a lower wall 10*a*, with a restricting orifice 15, for drainage of lubricant oil and by which is obtained said pressure equalization.

In the illustrated construction, the first acoustic chamber 50 is defined internal to a shell 60, which is formed for example by a two-piece body and provided inside the hollow body 10, the second acoustic chamber 51 being defined external to said shell 60 and internal to said hollow body 10.

According to a constructive option illustrated in the present invention, the fluid communication between the first and the second acoustic chambers 50, 51, is maintained through a first duct portion 70, which is provided through the second acoustic chamber 51 and connected to the gas inlet 12 of the hollow body 10 and provided with at least one window 72, which is opened to the second acoustic chamber 51 and through which is achieved the direct fluid communication between said second acoustic chamber and the gas inlet 12 of the hollow body 10. Although not illustrated, the second acoustic chamber 51, in a constructive option of the present invention, may keep direct fluid communication with the first acoustic chamber 50, being provided in a wall of the shell 60, maintaining indirect fluid communication with the gas inlet 12 of the hollow body 10, or may be also defined, in another non-illustrated constructive option, by the discontinuity of the duct 70, communicating said gas inlet 12 with the first acoustic chamber 50.

According to the present invention, the plurality of chambers of the hollow body 10 may further comprise (though not illustrated) at least one heat insulating chamber, which is provided in order to surround, at least partially and adjacently, at least one of the first and second chambers 50, 51, each heat insulating chamber being maintained only in restrict and pressure equalizing fluid communication with the inside of the shell (60) of the compressor. This equalizing fluid communication can be obtained, for example, by a restricting orifice provided in each chamber, for allowing the oil to pass from the innermost chamber to the outermost chamber and thence to the shell of the compressor.

In the construction presenting heat insulating chambers, the first duct portion 70 is continuous through said heat insulating chamber, in order to prevent the gas admitted by said first duct portion 70 from reaching the internal volume of these chambers. In the constructions in which the hollow body 10 presents acoustic chambers only, such as in the illustrated construction, each one of the surrounding chambers also defines a respective heat insulating chamber in relation to the surrounded chamber.

According to the present invention, the first acoustic chamber 50 is maintained in fluid communication with the gas outlet nozzle 22 of the hollow body 10 through a second duct portion 71 tightly mounted into an outlet orifice 61 of the shell 60 dimensioned for the tight passage of an inlet end 71*a* of the second duct portion 71 and opened to the inside of the first acoustic chamber 50, upon mounting said second duct portion 71 inside the first acoustic chamber 50. The second duct portion 71 presents a certain preferred extension, for instance substantially rectilinear which, as illustrated, is provided inside the first acoustic chamber 50, so that the respective inlet end 71*a* thereof is disposed close to an outlet end 70*a* of the first duct portion 70, terminating, for example, in the form of a deflector and having its axis parallel to the axis of said inlet end 71*a*.

Although not illustrated, other constructions and arrangements are possible for the second duct portion with variations in the shape (not rectilinear), extension and positioning of said portion inside the first acoustic chamber 50, without said modifications affecting the performance of the suction muffler of the present invention.

As illustrated, the first duct portion 70 is incorporated to the walls of the first acoustic chamber 50, which is for example in two pieces, with each half of its body being adjacent to an enlarged upper portion 50 of the first acoustic chamber 50, in order to define a respective half of the extension of said first duct portion 70.

According to the embodiment of the present solution illustrated in the enclosed figures, the shell 60 carries in a gas inlet 62, a nozzle in the shape of a cornet 64 opened to the inside of the compressor and aligned with the suction tube.

In this construction, the first duct portion 70 presents a window 72 defined by an extension discontinuity in one of the walls of the body of the first acoustic chamber 50 that defines a corresponding extension of said first duct portion 70.

In the illustrated construction, the parts of the body defining the first duct portion 70 are seated and attached to each other, by being fitted inside the walls of the adjacent surrounding chamber, which in this construction is the second acoustic chamber 51. The fixation between the parts defining the body of the first duct portion 70 is achieved by fitting a guide element 80 provided in one of the parts defined by the hollow body 10 and the shell 60, for example in an external wall of one of the parts of said first acoustic chamber 50, into a rail (not illustrated) provided in the other of said parts, for example in one of the internal walls of the second acoustic chamber 51.

According to the present invention, the gas admitted by the suction muffler through the cornet 64 is directly conducted to the inside of the first acoustic chamber 50, from which it is drawn to the inside of the compressor cylinder (not illustrated) by means of the second duct portion 71.

The arrangement of the surrounding chambers of the present invention increases the resistance to the transfer of heat generated by the compressor and transmitted to the gas drawn thereby, since the gas flow has to cross the wall of each outermost chamber, which is usually in a material of low thermal conductivity, the thickness of the gas mass contained in the outermost chamber, and the wall of the innermost chamber, before reaching the innermost acoustic chamber and thence the interior of the cylinder.

Moreover, the geometry of the innermost acoustic chamber allows the temporary formation of a cold gas volume, available to suction, which allows the acoustic effect of cylinder over-filling, improving the compressor efficiency.

A further advantage of the present solution is that the arrangement of the surrounding chambers allows the noise transmission to be attenuated in the direction of transmission. Part of the noise generated by operation of the suction valve is transmitted by the walls that form the muffler, which vibrate upon operation of the compressor. Thus, the existence of a gas volume between the immediately adjacent walls of the chambers of the present construction attenuates said transmission.

The invention claimed is:

1. A suction muffler for a reciprocating hermetic compressor, comprising:

a hollow body comprising:

a gas inlet and a gas outlet, which are in fluid communication with a gas supply to the compressor and with a suction side of the compressor, respectively;

a plurality of chambers including an innermost first acoustic chamber and a second acoustic chamber, which are in fluid communication with each other; and a duct portion provided with a gas outlet nozzle, wherein the innermost first acoustic chamber is surrounded substantially completely by the second acoustic chamber and in fluid communication with the gas outlet nozzle through the duct portion, a substantial part of the duct portion being extended into the innermost first acoustic chamber, and the second acoustic chamber is in fluid communication with the gas inlet of the hollow body.

2. The suction muffler according to claim 1, wherein:

the hollow body is provided with a plurality of duct portions including a first duct portion and a second duct portion;

the duct portion provided with the gas outlet nozzle is the second duct portion;

the first duct portion is provided through the second acoustic chamber, connected to the gas inlet of the hollow body, and provided with at least one window opened to the second acoustic chamber; and the fluid communication between the innermost first acoustic chamber and the second acoustic chamber is maintained through the first duct portion.

3. The suction muffler according to claim 2, wherein:

the plurality of chambers further comprises at least one thermal insulating chamber surrounding, at least partially and adjacently, at least one of the innermost first acoustic chamber and the second acoustic chamber; and the at least one thermal insulating chamber is maintained substantially in restrict and pressure equalizing fluid communication with inside of a shell of the compressor.

4. The suction muffler according to claim 3, wherein the first duct portion is continuous through the at least one thermal insulating chamber.

5. The suction muffler according to claim 2, wherein, the first duct portion extends to inside of the innermost first acoustic chamber.

6. The suction muffler according to claim 5, wherein, the first duct portion has an outlet end provided close to an inlet end of the second duct portion.

7. The suction muffler according to claim 6, wherein the outlet end of the first duct portion has an axis parallel to an axis of the inlet end of the second duct portion.

8. The suction muffler according to claim 7, wherein the substantial part of the second duct portion extended into the innermost first acoustic chamber is substantially rectilinear.

9. The suction muffler according to claim 8, wherein the first duct portion is incorporated in part of walls which define the innermost first acoustic chamber.

10. The suction muffler according to claim 9, wherein the outlet end of the first duct portion is in a form of a deflector.

11. The suction muffler according to claim 10, wherein the innermost first acoustic chamber is defined inside a shell formed in two pieces, which are fixed to each other and provided inside the hollow body.

12. The suction muffler according to claim 11, wherein the two pieces of the shell is fixed to each other by being fitted inside walls of an adjacent surrounding chamber.

13. The suction muffler according to claim 12, wherein:

either one of the hollow body or the shell is provide with a guide element, and another one of the hollow body or the shell is provided with a rail; and the two pieces of the shell is fixed to each other by fitting the guide element into the rail.

14. The suction muffler according to claim 13, wherein the second acoustic chamber is defined external to the shell and internal to the hollow body.

15. The suction muffler according to claim 1, wherein at least the innermost first acoustic chamber and the second acoustic chamber are eccentrically provided.

16. A suction muffler for a reciprocating hermetic compressor, comprising:

a hollow body having a gas inlet and a gas outlet, which are respectively in fluid communication with a gas supply to the compressor and with a suction side of the compressor, a plurality of chambers provided in surrounding superposed layers and including an innermost first acoustic chamber in fluid communication with the gas outlet of the hollow body, a second acoustic chamber surrounding at least partially the first acoustic chamber and in fluid communication with at least partially the first acoustic chamber and in fluid communication with at least one of the parts defined by said first acoustic chamber and by the gas inlet of the hollow body, and at least one thermal insulating chamber provided to surround, at least partially and adjacently, at least one of the first and second acoustic chambers, each thermal insulating chamber being maintained only in restrict and pressure equalizing fluid communication with an inside of a shell of the compressor.

* * * * *

UNITED STATES PATENT AND TRADEMARK OFFICE

CERTIFICATE OF CORRECTION

PATENT NO. : 7,147,082 B2
APPLICATION NO. : 10/480210
DATED : December 12, 2006
INVENTOR(S) : Dietmar Erich Bernhard Lilie et al.

It is certified that error appears in the above-identified patent and that said Letters Patent is hereby corrected as shown below:

On title page, item [75]
For the first inventor's name; delete "Berhard" and insert --Bernhard--, therefor.

For § 371 (c)(1), (2), (4) date; delete "Dec. 10, 2003" and insert --Feb. 24, 2004--, therefor.

Signed and Sealed this

Tenth Day of April, 2007

JON W. DUDAS
*Director of the United States Patent and Trademark Office*